United States Patent [19]

Borowick et al.

[11] 4,092,647

[45] May 30, 1978

[54] LINE SOURCE ANTENNA FOR SMALL ANGLE ELECTRONIC BEAM SCANNING

[75] Inventors: John Joseph Borowick, Bricktown; Boaz Gelernter, Elberon; Nathan Lipetz, Oakhurst; Richard A. Stern, Allenwood, all of N.J.

[73] Assignee: The United States of America as represented by the Secretary of the Army, Washington, D.C.

[21] Appl. No.: 754,642

[22] Filed: Dec. 27, 1976

[51] Int. Cl.[2] ..... H01Q 13/10; H01Q 1/00; H01Q 3/26

[52] U.S. Cl. ..... 343/768; 343/787; 343/854

[58] Field of Search ..... 343/768, 787, 854

[56] References Cited

U.S. PATENT DOCUMENTS

| | | | |
|---|---|---|---|
| 2,946,056 | 7/1960 | Shanks | 343/768 |
| 2,994,874 | 8/1961 | Kihn et al. | 343/768 |
| 3,004,259 | 10/1961 | Shanks et al. | 343/768 |
| 3,109,174 | 10/1963 | Plummer | 343/854 |
| 3,855,597 | 12/1974 | Carlise | 343/787 |

OTHER PUBLICATIONS

Skolnik, Merrill J., *Radar Handbook,* N.Y. McGraw--Hill, 1970, pp. 12-11, 13.

*Primary Examiner*—Alfred E. Smith
*Assistant Examiner*—Harry Barlow
*Attorney, Agent, or Firm*—Nathan Edelberg; Sheldon Kanars; Edward Goldberg

[57] ABSTRACT

A line source antenna adapted for a light weight, compact phased array radar and consisting of a plurality of series fed radiating slots periodically located in the narrow side wall of a length of waveguide together with non-reciprocal latching ferrite phase shifters including dielectric loading sections and matching transformer sections on either side of phase shifters located between adjacent slot pairs.

9 Claims, 5 Drawing Figures

FIG. 1
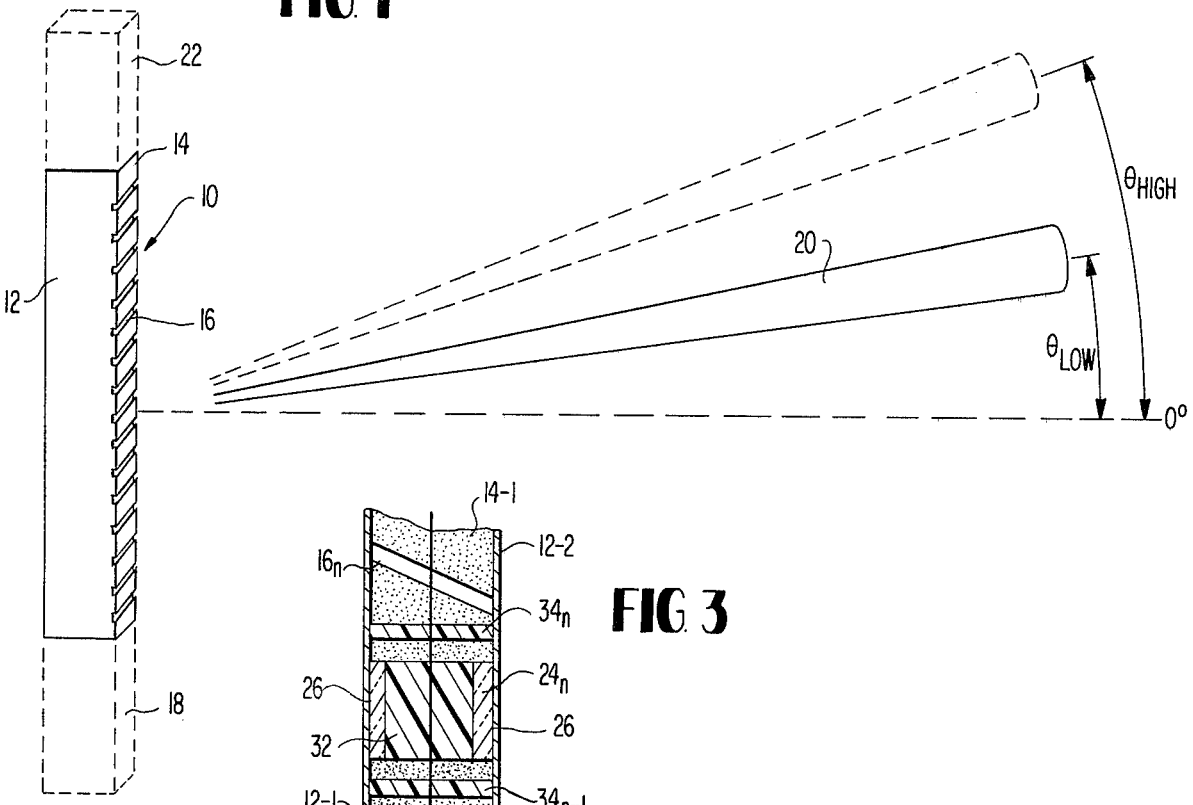
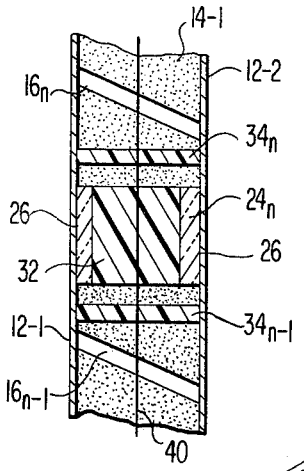
FIG. 3
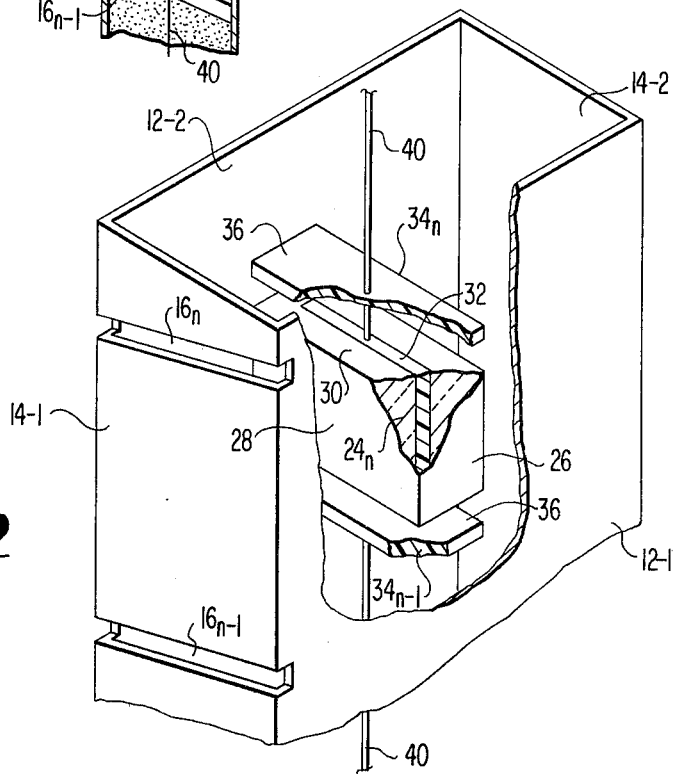
FIG. 2

LINE SOURCE ANTENNA FOR SMALL ANGLE ELECTRONIC BEAM SCANNING

The invention described herein may be manufactured and used by or for the Government for governmental purposes without the payment of any royalties thereon or therefor.

BACKGROUND OF THE INVENTION

This invention relates generally to radar antennas and more particularly to a line source array in which the beam may be electronically scanned over a limited angular range.

Small angle electronic scanning of a radar beam is required in many surveillance applications, including personnel and vehicle detection, fire registration, projectile tracking, etc. One such antenna has been developed by Rockwell International and has been described in an article entitled "Inexpensive Phased Array Opens Up New Radar Applications", by Richard T. Davis, which article appeared in the publication entitled *Microwaves* in August, 1975, at pages 15 and 16. The phased array antenna disclosed therein is based on the series ferrite scan principle in which a waveguide having series connected ferrite phase shifters inserted lengthwise between each radiating element has current applied which induces a longitudinal magnetic field in the ferrite. Electronic beam scanning is effected by controlling the propagating velocity or phase shift per unit length of the ferrite loaded waveguide.

Accordingly, it is an object of the present invention to provide an improved phased array operated in accordance with the series ferrite scan principle.

SUMMARY

Briefly, the subject invention is directed to a line source antenna comprising a plurality of side wall, shunt slot radiators in an air filled waveguide section with a non-reciprocal latching phase shifter with matching transformers located between pairs of slots. Change of the insertion phase between adjacent slots is provided by a switching wire element running centrally through the phase shifters and matching transformers along the central axis thereof which is co-extensive with the longitudinal central axis of the waveguide. A common electronic driver is coupled to a respective switching wire element to energize (latch) a selected number of the ferrite elements which are thus operated in sets.

BRIEF DESCRIPTION OF THE DRAWINGS

FIG. 1 is a schematic representation illustrative of the operation of the subject invention;

FIG. 2 is an isometric view with sections thereof partially cut away and being illustrative of the preferred embodiment of the subject invention;

FIG. 3 is a partial vertical central cross-section of the embodiment shown in FIG. 2;

DESCRIPTION OF THE PREFERRED EMBODIMENT

Figure 4:
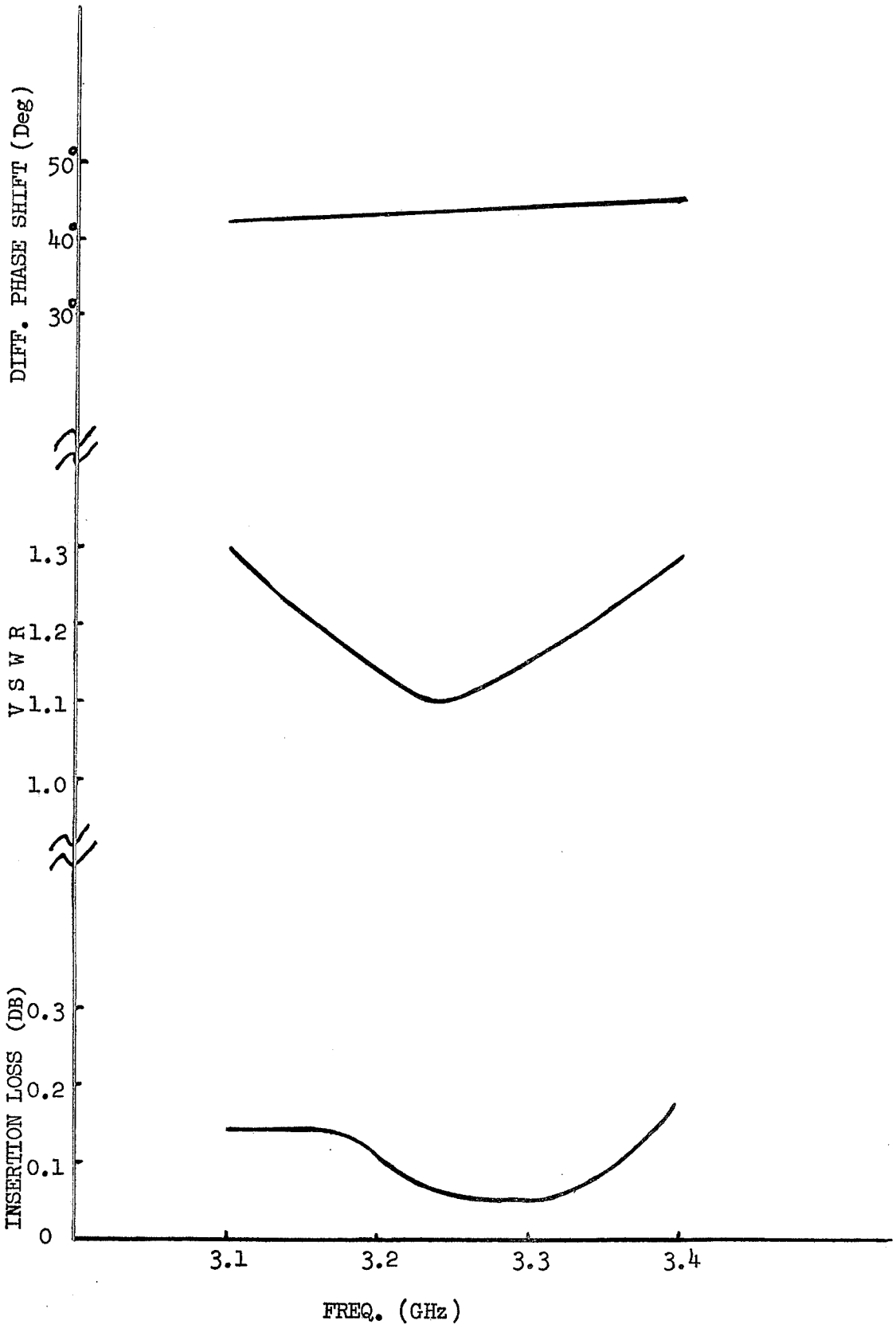
FIG. 4 is a set of curves illustrative of the operating characteristics of one phasor cell of the subject invention.

Referring now to FIG. 1, there is disclosed a substantially vertically aligned line source antenna array comprised, inter alia, of a section of rectangular (S-band) waveguide 10 having broad and narrow side walls 12 and 14 mutually opposing each other with a plurality of mutually parallel slanted shunt slot radiators 16 formed in one narrow side wall 14 and which wrap around and extend slightly into the broad walls 12. Input means 18 including radar apparatus having an RF source is adapted to feed the waveguide section 10 and produce a radiated beam 20 from the slot radiators 16. Since RF energy is propagated through the waveguide section 10, suitable microwave load means 22 is required to be coupled to the opposite end of the waveguide.

Referring now to the invention in greater detail and accordingly to FIG. 2, there is disclosed the means for selectively switching the position of the beam 20 to effect scanning in the elevation plane, for example, when the antenna is vertically oriented as in FIG. 1. Looking at a portion of the waveguide section 10 through the rear narrow side wall 14-2 toward the forward side wall 14-1, there is shown one pair of angulated shunt radiating slots $\mathbf{16}_{n-1}$ and $\mathbf{16}_n$ which defines the boundary of one cell of the array. Mid-way between the slots $\mathbf{16}_{n-1}$ and $\mathbf{16}_n$ is located a generally rectangular cross-sectional member $\mathbf{24}_n$ of ferrite material having a transverse cross sectional dimension relative to the longitudinal axis of the waveguide which is substantially less than the width of broad walls 12-1 and 12-2 of the waveguide 10. One pair of end faces 26 of the ferrite member 24 are contiguous with the broad walls 12-1 and 12-2. The larger pair of exposed faces 28 are oriented parallel to the narrow side walls 14-1 and 14-2. The smaller pair of exposed end faces 30 are orthogonal i.e. transverse to both the broad and narrow walls of the waveguide 10. Accordingly, the ferrite member $\mathbf{24}_n$ defines a generally rectangular solid having a length dimension along the longitudinal axis of the waveguide which is substantially twice the thickness dimension which is transverse to the waveguide's longitudinal axis.

Loading of the ferrite member $\mathbf{24}_n$ is provided by a dielectric element 32 having a thickness substantially less than that of the ferrite member $\mathbf{24}_n$. The dielectric loading element 32 is a solid piece of dielectric having a dielectric constant of for example $K = 16$ which is inserted through the entire length of the ferrite member $\mathbf{24}_n$. The dielectric loading element 32 consequently is centrally located within and totally surrounded by the ferrite member $\mathbf{24}_n$ in a plane common to the central longitudinal plane intersecting the broad walls 12 of the waveguide section 10.

A transformer section is provided on either side of the ferrite member $\mathbf{24}_n$ intermediate the slots $\mathbf{16}_{n-1}$ and $\mathbf{16}_n$ by means of the dielectric elements $\mathbf{34}_{n-1}$ and $\mathbf{34}_n$. The elements $\mathbf{34}_{n-1}$ and $\mathbf{34}_n$ are selected to have the same dielectric constant as the loading element 32 i.e. $K = 16$. The thickness of the dielectric elements $\mathbf{34}_{n-1}$ and $\mathbf{34}_n$ is relatively small compared to the length of ferrite member $\mathbf{24}_n$ and have opposing faces 36 which have dimensions corresponding to the transverse cross sectional dimensions of the ferrite member $\mathbf{24}_n$. The ferrite member $\mathbf{24}_n$ and the dielectric elements $\mathbf{34}_{n-1}$ and $\mathbf{34}_n$ on either side thereof are accordingly oriented parallel to one another so that if one were to look through the waveguide 10 along its longitudinal central axis, the faces 30 of the ferrite member $\mathbf{24}_n$ and the faces 36 of the dielectric elements $\mathbf{34}_{n-1}$ and $\mathbf{34}_n$ would be coincident. The separation of the dielectric elements $\mathbf{34}_{n-1}$ and $\mathbf{34}_n$ between the ferrite block $\mathbf{24}_n$ and the adjacent slot $\mathbf{16}_{n-1}$ or $\mathbf{16}_n$; moreover, is selectively chosen to provide an appropriate length air gap so that the dielectric elements $34_{n-1}$ and $34_n$ act as matching transformers for ferrite member $24_n$.

Energization of the ferrite member $24_n$ is achieved by means of a latching switching wire conductor 40 which runs through the center of the dielectric loading element within the ferrite thereby inducing a magnetic field within the ferrite in a plane transverse to the wire conductor. This is in contrast to the aforementioned Davis article approach to series ferrite scan wherein a longitudinal magnetic field is induced within the waveguide section. The wire conductor 40 also passes through the dielectric transformer sections $34_{n-1}$ and $34_n$ along the central longitudinal axis of the waveguide 10 and the ferrite member $24_n$. The latching wire 40 is adapted to commonly energize the ferrite elements of a selected number of cells, typically five and accordingly the whole array is operated in groups switched by a respective driver circuit coupled to a respective switching conductor.

In operation, current in the wire conductor 40 causes the magnetization state of the ferrite material to assume and maintain a predetermined value thereby changing the insertion phase between adjacent radiating slots. Latching is thus said to occur. One can predict the scan position extremes by using the equation for simple beam pointing for individual elements of an array. This equation can be expressed as:

$$\theta = \sin^{-1}(\lambda_0 \Delta\phi / 2\pi d) \qquad (1)$$

where $\theta$ is the beam pointing angle with respect to boresight i.e. 0°, $\lambda_0$ is the free space wavelength, $\Delta\phi$ is the phase difference between slots, and $d$ is the slot spacing or separation.

Figure 5:
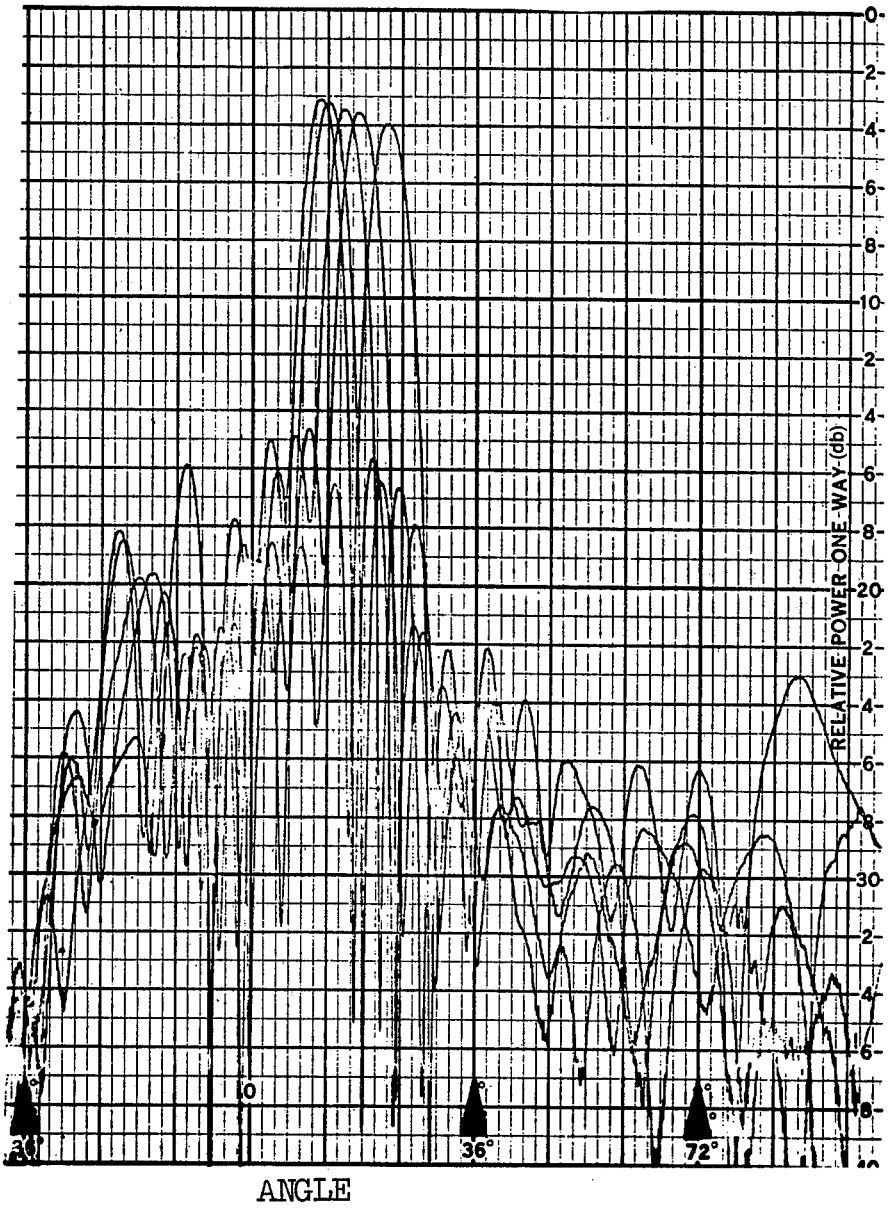
FIG. 5 is an illustration of a set of composite antenna patterns being illustrative of the operation of the subject invention.

FIG. 4 is illustrative of three separate operating characteristic curves for apparatus of the type shown in FIG. 2 for operation at S-band. FIG. 5, on the other hand, shows a typical set of composite antenna patterns measured for a 16 slot (15 cell) line source from the low to the high magnetization or phase states at an operating frequency of 3.25GHz. FIG. 5 indicates that the peaks vary between 11° and 22°, indicating a scan angle on the order of 10° being obtained which would agree with the value of $\theta_{low} = 9°$ and $\theta_{high} = 20°$ being obtained from equation (1) for a slot spacing of $d = 2.363$ inches.

Thus what has been shown and described is an S-band linear array wherein a set of phasor elements are driven simultaneously by a common electronic flux driver, whereas conventional phased arrays require that each phasor be driven by its own respective driver circuit. Furthermore, the improvements provided by the subject invention with respect to the series ferrite scan principle over prior art apparatus are the following: a latching configuration is incorporated for switching the ferrite toroids so that no holding current is required and therefore a reduction in drive power is achieved; faster switching is achieved; reduced temperature sensitivity is achieved as a result of the flux drive latching technique thereby resulting in beam pointing which is more nearly invariant with temperature; and greater freedom in slot conductance values is realized due to the fact that the radiating slots are located above an air filled section of waveguide as opposed to being in a waveguide having continuous ferrite loading.

Having thus disclosed what is considered to be the preferred embodiment of the subject invention, we claim:

1. In a line source microwave antenna coupled to a source of RF energy and adapted to provide electronic beam scanning in a plane including the line source by means of at least one electronic driver circuit, the improvement comprising:

a section of waveguide microwave transmission line having broad and narrow side walls and including a lengthwise array of radiating slots periodically located in one side wall of said waveguide section;

latching ferrite phase shifter means requiring no holding current centrally located within said waveguide section between adjacent pairs of slots of said array, each said ferrite phase shifter means including a ferrite element and a dielectric loading element enclosed within said ferrite element; and including phase shifter control means coupled to said driver circuit for controlling the operative state of said ferrite phase shifter means in response to output signals from said driver circuit and thereby effect a relatively faster and substantially temperature invariant scanning of a beam of RF energy radiated from said array of slots, said driver circuit including a common electrical latching conductor passing centrally through said ferrite and dielectric loading elements and extending across a plurality of said slots for energizing said ferrite phase shifter means.

2. The antenna as defined by claim 1 wherein said array of radiating slots comprises a plurality of angulated slots in one narrow side wall.

3. The antenna as defined by claim 2 wherein said slots extend into said broad walls.

4. The antenna as defined by claim 1 wherein said array of slots comprises a plurality of mutually parallel shunt slots in one narrow side wall and wherein each said phase shifter means comprises a nonreciprocal latching ferrite phase shifter.

5. The antenna as defined by claim 1 including matching dielectric transformer means spaced from each side of each said ferrite phase shifter between a respective pair of slots.

6. The antenna as defined by claim 5 wherein said ferrite elements are in contact with said broad side walls.

7. The antenna as defined by claim 5 wherein said transformer means comprises a pair of dielectric elements having a predetermined air gap spacing about each said ferrite element.

8. The antenna as defined by claim 7 wherein said pair of dielectric elements have substantially the same dielectric constant as said dielectric loading element.

9. The antenna as defined by claim 7 wherein said ferrite element generally defines a rectangular solid and wherein said dielectric loading means is a solid member centrally located therein, extending through its length which is coextensive with the central longitudinal axis of said waveguide section.

* * * * *